US005810322A

United States Patent [19]

Zhao et al.

[11] Patent Number: 5,810,322

[45] Date of Patent: Sep. 22, 1998

[54] APPARATUS FOR MOUNTING A COMPRESSOR

[76] Inventors: Guoquan Zhao, 4913 Ledyard Dr., Manlius, N.Y. 13104; A. Bruce Buchholz, 5321 Gatehouse Rd., Tully, N.Y. 13159; Richard J. Duell, 204 Scarboro Dr., Syracuse, N.Y. 13209; Werner Adomeit, 19 Necturine La., Liverpool, N.Y. 13090

[21] Appl. No.: 578,351

[22] Filed: Dec. 26, 1995

[51] Int. Cl.[6] ..... F16M 1/00

[52] U.S. Cl. ..... 248/675; 248/606; 248/674

[58] Field of Search ..... 248/544, 603, 248/606, 632, 634, 638, 635, 612, 674, 678, 659, 558, 671, 581, 621

[56] References Cited

U.S. PATENT DOCUMENTS

| | | | |
|---|---|---|---|
| Re. 31,525 | 2/1984 | Boyd, Jr. et al. | 417/360 |
| 1,718,461 | 6/1929 | Harder | 248/612 |
| 2,209,477 | 7/1940 | Reibel | 248/606 |
| 2,575,858 | 11/1951 | Bennett | 248/606 |
| 2,729,846 | 1/1956 | Reed | 248/606 |
| 2,885,142 | 5/1959 | Eberhart | 230/117 |
| 2,952,430 | 9/1960 | Garman | 248/26 |
| 4,416,594 | 11/1983 | Ichikawa | 417/360 |
| 4,849,667 | 7/1989 | Morrill | 248/674 |
| 5,335,893 | 8/1994 | Opp | 248/632 |
| 5,337,580 | 8/1994 | Zhao et al. | 62/262 |

*Primary Examiner*—Leslie A. Braun
*Assistant Examiner*—Gwendolyn W. Baxter

[57] ABSTRACT

Apparatus (20) for mounting the horizontal compressor (10) of a vapor compression air conditioner to a foundation includes an L-shaped bracket (21) at each compressor end, each bracket having a horizontal leg (21H) adapted for attachment to mounting lugs (11) which extend laterally outwardly from the compressor casing. Each bracket is sized and otherwise configured so that its vertical leg (21V) extends upwardly from the horizontal leg along the outside of an end (102 or 103) of the compressor casing (101) to a point above the drive shaft axis of rotation ($A_R$) of the compressor motor. A pin (22) is secured to and extends outwardly from the vertical leg of the bracket. The longitudinal axis of each pin is coincident with the driveshaft axis of rotation. Each pin extends into a pin socket (25) in a respective mounting support (24) which is securely fastened to a foundation (30) such as the base pan of an air conditioner. A resilient grommet (23) is disposed between each pin and its respective pin socket and vibrationally isolates the compressor, from the mounting support and the foundation.

5 Claims, 2 Drawing Sheets

APPARATUS FOR MOUNTING A COMPRESSOR

BACKGROUND OF THE INVENTION

This invention relates generally to apparatus for mounting rotating machines. More particularly the invention relates to an apparatus for mounting a small horizontal compressor. A horizontal compressor is a compressor whose motor driveshaft has an axis of rotation that, when installed for operation, is horizontal or nearly so. Such a compressor will usually have a generally cylindrical casing with a longitudinal axis that is coincident with the motor shaft axis of rotation. The apparatus is adaptable for use in mounting a horizontal compressor in a window room air conditioner (WRAC).

A compressor vibrates when it is operating. The vibration is more pronounced than the vibration produced by a simple electric motor of similar size because there are internal components and external connections that make a compressor both statically and dynamically imbalanced. If the compressor is rigidly mounted to a foundation, which, in many WRACs, is the base pan of the unit enclosure, the vibration is transmitted to the foundation. A base pan in such applications acts as an elastic plate and therefore torsional vibrational energy from the compressor easily excites the base pan. The result is induced vibration in the air conditioner base plate and often the entire enclosure. This vibration can be transmitted to the structure surrounding the WRAC and also contribute to the overall radiated noise. This vibration and noise is undesirable and, for this reason, compressors are frequently resiliently mounted. FIG. 1 depicts a horizontal compressor in a prior art mounting installation. Compressor 10 is secured to mounting plate 12 by means of mounting lugs 11. Grommets 15 provide some measure of insulation between plate 12 and foundation 13. A prior art mount such as shown in FIG. 1 does not completely prevent the transmission of torsional vibrational energy produced by the compressor to the plate because of the relatively large moment arm between the axis of rotation and the point of attachment and also because the resonant frequency of the mounting plate may be close to the compressor vibrational frequency.

Many rotating machines, including electric motors and the like, have projections that extend from their casings and are aligned with the compressor drive shaft rotational axis. In such a machine, these projections are often inserted into mounting brackets and support the weight of the compressors. There is often vibration absorbing material placed between the projections and the mounting bracket. Examples of this type of mountings for motors are disclosed in U.S. Pat. No. 2,885,142, issued 5 May 1959 to Eberhart; U.S. Pat. No. 2,952,430, issued 13 Sep. 1960 to Garman; and U.S. Pat. Re. 31,525, reissued 28 Feb. 1984 to Boyd, Jr. et al. U.S. Pat. No. 4,416,594, issued 22 Nov. 1983 to Ichikawa. Although this type of mounting can be effective in minimizing the transmission of vibration, many compressors do not have such axially aligned projections; and to add them would increase the cost of the compressor and complicate its manufacture.

What is needed is a simple and inexpensive mounting that does not require axial projections and that minimizes the transmission of torsional vibrational energy from a compressor to its supporting foundation.

SUMMARY OF THE INVENTION

The present invention is an apparatus for mounting a compressor. The apparatus is intended for use in an application where the compressor is mounted horizontally, that is, where the axis of rotation of the compressor motor driveshaft is horizontal or nearly so.

In one exemplary embodiment, a separate L-shaped bracket supports each end of the compressor above a foundation. The horizontal or "base" portion of each L-shaped bracket is attached to a respective mounting lug located near an end of the compressor. The L-shaped bracket is sized and otherwise configured so that its vertical branch, or "riser" portion, extends from the base portion along the outside of the end of the compressor casing to a point above the drive shaft axis of rotation of the compressor. A support pin extends from and is secured to the riser portion of the bracket and has its longitudinal axis coincident with the driveshaft axis of rotation. A resilient grommet surrounds the pin. The pin and grommet extend into the socket of a mounting support secured to the foundation. The grommet minimizes the transmission of vibrations from the compressor to the mounting support and foundation. The transmission of torsional energy from the compressor to the foundation is also minimized by having the supporting pin aligned with the compressor rotational axis.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENT

Figure 1:
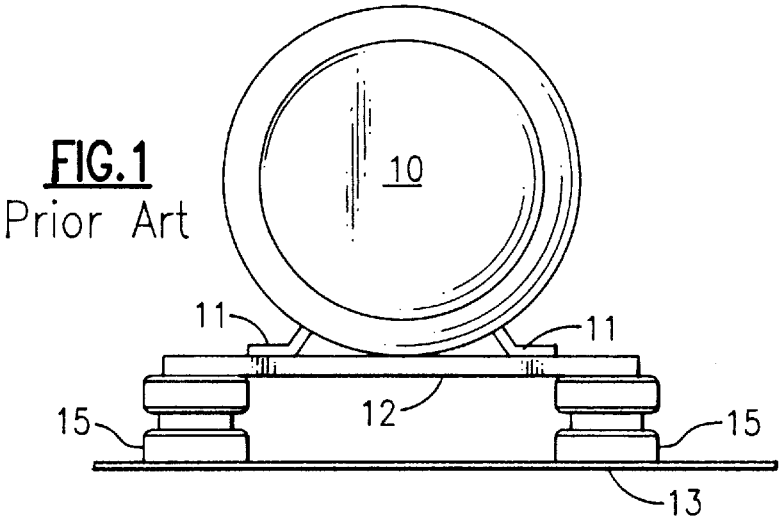
FIG.1 Prior Art
FIG. 1 is an end view of a compressor mounted in accordance with the prior art.
Figure 3:
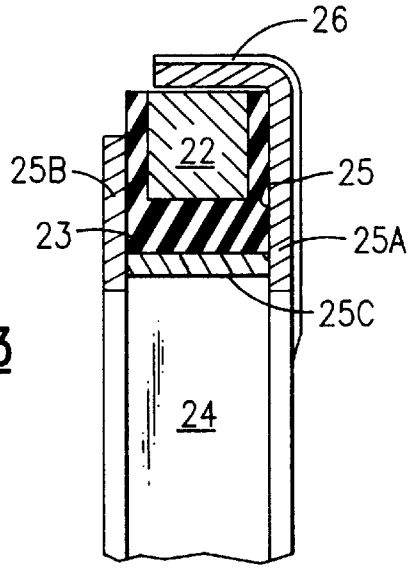
FIG. 3 is a sectional elevation view, in the direction A of FIG. 2, of the distal end of the mounting support of the present invention.
Figure 2:
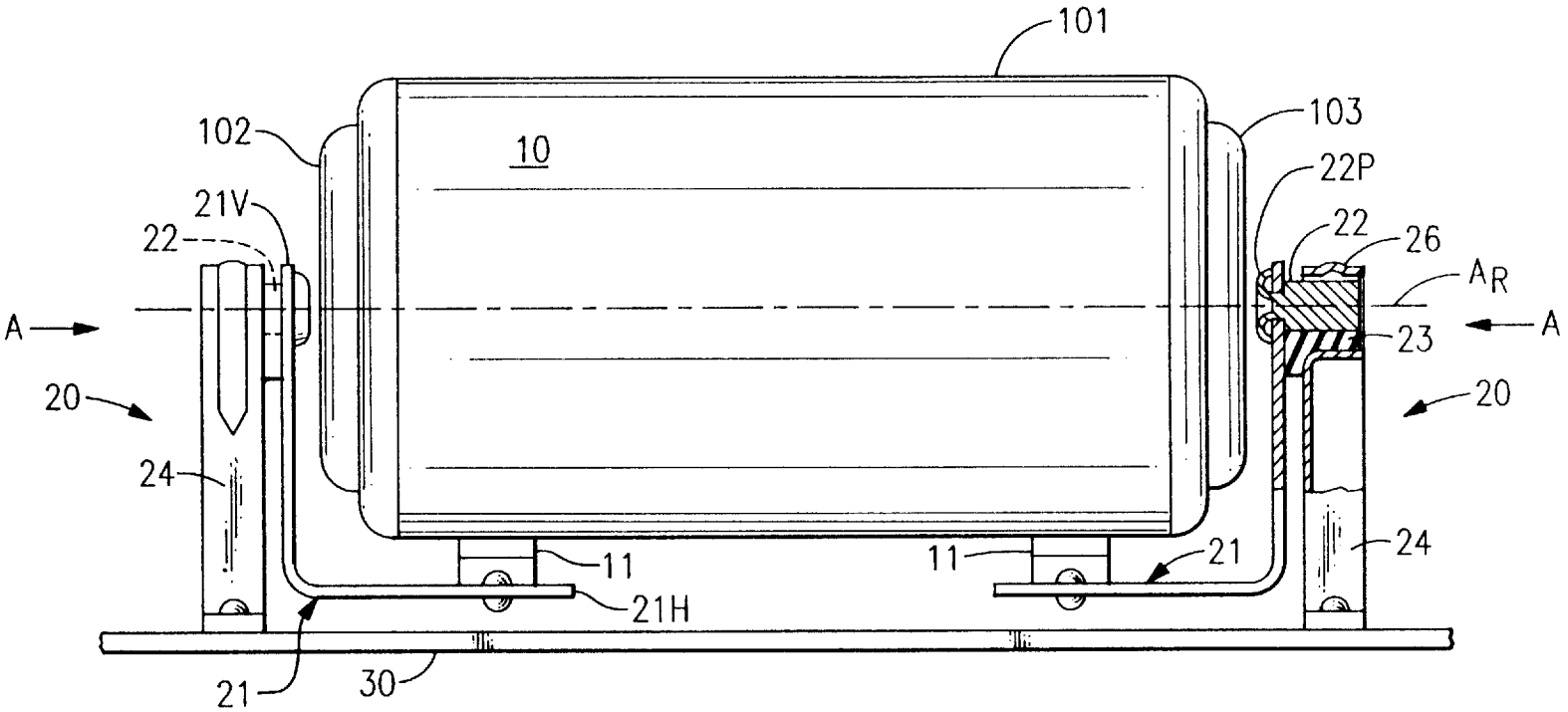
FIG. 2 is a side elevation view, partly in section, of a compressor mounted using the apparatus of the present invention.

FIG. 2 shows compressor 10 mounted to a foundation 30 using the mounting apparatus 20 of the present invention at each end thereof. The foundation 30, in this exemplary embodiment, is the base pan of an air conditioner system (not shown). Compressor 10 operates with its drive shaft rotational axis $A_R$ oriented horizontally. Compressor 10 has casing 101, first end 102 and second end 103. Mounting lugs 11 are fixed to and extend horizontally outwardly from the bottom of casing 101 near each end thereof. The lugs are similar to lugs 11 of the conventional prior art mounting installation depicted in FIG. 1, wherein the mounting plate 12 which is supported on grommets 15 mounted to the foundation 13. Although the grommets 15 of the conventional prior art mounting system provide some measure of insulation, the mounting apparatus of the present invention is superior in minimizing the transmission of vibrations from the compressor to the foundation.

Each of the apparatus 20 comprises a bracket 21, a support 24, a pin 22, and a resilient grommet 23. The pin 22 extends into a pin socket 25 (FIG. 4), described more fully below, in the upper or distal end of mounting support 24. The resilient grommet 23 is disposed between the pin 22 and the pin socket. Each mounting support 24 is fixed to foundation 30 by means of rivets, bolts and nuts, or the like.

More specifically, the bracket 21 is L-shaped, in this embodiment, and includes a horizontal leg 21H, secured directly to the mounting lugs 11, and a vertical leg 21V which extends vertically to a point above the axis $A_R$ of the compressor 10, adjacent to but spaced from a respective compressor end 102, 103. The vertical leg 21V has an opening 34 therethrough aligned with the axis $A_R$ for receiving one end 22P of the pin 22. The end 22P of the pin is preferably hollow and is swaged over, after insertion into the bracket opening 34, to secure the pin in place. In the depicted embodiment, the mounting support 24 is formed of a pair of spaced L-shaped brackets 25A and 25B, each having a vertically extending leg and a horizontally extending mounting base, and a horizontal spacer 25C extending between the distal portions of the vertically extending legs of the brackets 25A and 25B. The support 24 includes a pin receiving socket 25 therein defined in the region between the distal ends of the legs of the spaced brackets 25A and 25B superadjacent the horizontal spacer 25C, within which is disposed the resilient grommet 23. The grommet 23 has a U-shaped pocket 32 therein for receiving the pin 22. The grommet, in this embodiment surrounds the sides and bottom of the pin 22 and is made from rubber, neoprene, or other resilient, vibration absorbing material to minimize any transmission of vibration from the compressor to the support 24. The size and shape of the bracket 21 and the vertical distance from the foundation to the pocket 32, as determined by the height of the support, is selected to assure that the compressor is supported above the foundation, whereby the compressor's entire weight passes into the foundation through the pins 22.

Figure 4:
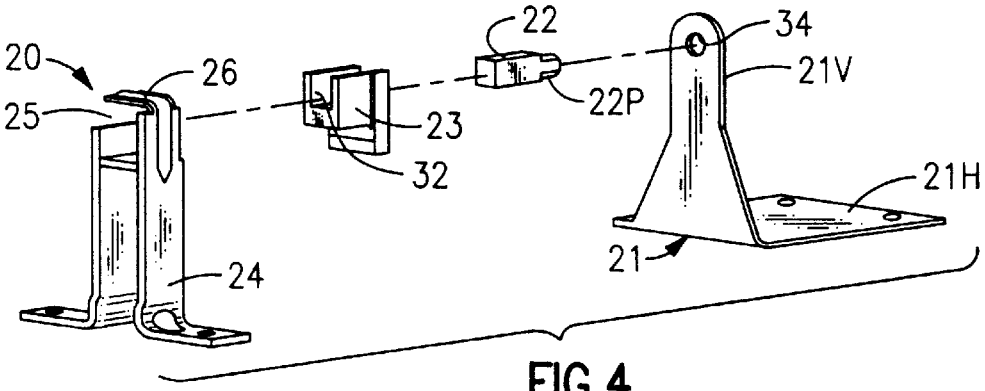
FIG. 4 is an exploded view of the mounting apparatus shown in FIG. 2.

The pin 22 has a longitudinal axis which, when installed, is coaxial with the compressor drive shaft axis $A_R$, thereby minimizing the transmission of torsional energy from the compressor to the support 24 and foundation 30. The pin cross section, as best shown in the exploded view of FIG. 4, is square to prevent rotation, but could be other shapes. A horizontal tab 26, integral with and extending from the distal end of the vertical leg of the bracket 25A of the support 24, extends over the top of the pin and grommet and prevents the pin from lifting out of the support.

A prototype of the apparatus of the present invention was tested in a WRAC. We observed reductions in vibration levels of 10 to 15 dB in the base pan of the WRAC when compared to prior art mounting systems such as shown in FIG. 1.

We claim:

1. Apparatus (20) for resiliently mounting a compressor (10) to and spaced above a foundation (30), said compressor having a casing (101), a rotational axis ($A_R$), and a mounting lug (11) extending laterally outwardly from said casing, said apparatus comprising:

a mounting support (24) having a pin receiving socket (25) formed in a distal end thereof, said mounting support adapted to be affixed to the foundation so that it extends vertically upwardly therefrom;

a bracket (21) adjacent said mounting support, said bracket adapted to be affixed to the compressor mounting lug and including a horizontal leg (21H) a vertically extending leg (21V) having an opening (34) therethrough located so as to be aligned with the rotational axis of the compressor when said bracket is affixed to the compressor;

a resilient material body disposed within said pin receiving socket, said resilient material body having a pin receiving pocket; and a longitudinally extending pin (22) extending through said opening and secured to said bracket, said pin extending into said pin receiving pocket and between and in contact with said pin and said mounting support to dampen vibration transmission from said pin to said mounting support.

2. The apparatus of claim 1 wherein said resilient material body is in the form of a grommet having a pin receiving pocket therein, said pin extending into said pocket.

3. The apparatus of claim 2 wherein said pin has non-circular cross section.

4. The apparatus of claim 3 wherein said pin has a square cross section.

5. In an air conditioning system, said system including a compressor having a casing and a drive shaft extending therethrough, mounting lug means extending laterally outwardly from said casing, and a foundation, wherein said compressor casing includes a pair of oppositely facing ends and a drive shaft has an axis of rotation perpendicular to said ends, an improved compressor mounting system comprising:

mounting apparatus disposed at each end of said compressor, each of said mounting apparatus including a mounting support, a mounting bracket, a resilient grommet, and a support pin;

wherein each of said mounting supports includes a pin receiving socket therein at its distal end, said resilient grommet being disposed within said pin receiving socket, said grommet including a pin receiving pocket therein, said bracket being adapted to be secured to said mounting lug means and adapted to be extended vertically adjacent to and spaced from one of said compressor casing ends, said bracket having an opening therethrough, said pin extending into said opening and secured to said bracket and adapted to be longitudinally coaxially with said drive shaft axis of rotation into said pin receiving pocket, said resilient grommet disposed between said pin and said bracket thereby dampening vibration transmission from said pin to said bracket, said compressor being disposed above said foundation with the full weight of said compressor being passed through said pins to said foundation.

* * * * *